US005915759A

United States Patent [19]

Logerot et al.

[11] Patent Number: 5,915,759

[45] Date of Patent: Jun. 29, 1999

[54] METHOD OF MAKING AN ELECTRICAL CONTACT OF THE INSERTION FORCE TYPE

[75] Inventors: Bernard Logerot, Santans; Jean-Pierre Huguenet, Biarne, both of France

[73] Assignee: Amphenol Socapex, Courbevoie, France

[21] Appl. No.: 08/625,220

[22] Filed: Apr. 1, 1996

[30] Foreign Application Priority Data

Apr. 4, 1995 [FR] France ..... 95 03940

[51] Int. Cl.[6] ..... H01R 43/16

[52] U.S. Cl. ..... 29/874; 29/33 M

[58] Field of Search ..... 29/33 M, 558, 29/559, 408, 874, 882

[56] References Cited

U.S. PATENT DOCUMENTS

| | | | |
|---|---|---|---|
| 3,391,567 | 7/1968 | Gregory . | |
| 5,230,642 | 7/1993 | Schempp | 439/751 |
| 5,329,697 | 7/1994 | Gentry | 29/874 |
| 5,575,666 | 11/1996 | Dent | 439/82 |

FOREIGN PATENT DOCUMENTS

| | | |
|---|---|---|
| 0 236 186 | 9/1987 | European Pat. Off. . |
| 0 373 428 | 6/1990 | European Pat. Off. . |
| 2 321 228 | 4/1977 | France . |
| 1 534 887 | 12/1978 | United Kingdom . |
| WO 86/04743 | 8/1986 | WIPO . |

*Primary Examiner*—Peter Vo
*Assistant Examiner*—Kevin G. Vereene
*Attorney, Agent, or Firm*—Bacon & Thomas, PLLC

[57] ABSTRACT

A method of fabricating the fixing portion of an electrical contact and a portion that forms a contact terminal includes the steps of machining the side face of the fixing portion so as to define a surface of revolution, drilling a blind axial bore in the fixing portion to open out its free end, and machining the fixing portion in such a manner that in a middle part of the fixing portion, in a plane perpendicular to the longitudinal axis, the fixing portion has a greater dimension in a first direction than in a second direction perpendicular to the first direction, and two orifices are formed to open into the axial bore and into the side face, the two orifices having a common axis extending in said second direction and intersecting the longitudinal axis.

6 Claims, 3 Drawing Sheets

METHOD OF MAKING AN ELECTRICAL CONTACT OF THE INSERTION FORCE TYPE

The present invention relates to an electrical contact, and more precisely to an electrical contact of the insertion force type.

BACKGROUND OF THE INVENTION

When it is desired to mount an electrical contact on a printed circuit, it is advantageous to use a contact of the insertion force type and is similar to that shown in accompanying FIG. 1. Such a contact 10 comprises a fixing portion 14 and a portion 12 forming a contact terminal. The fixing portion 14 is pushed into a plated through hole 16 of the printed circuit 18 in which the contact 10 is to be connected. To enable the electrical contact to be fixed mechanically and also to provide an electrical connection between the contact proper and the metal plating of the hole 16, the portion 14 is shaped like the eye of a needle. The portion 14 has a curved side surface 20 and said portion 14 also has a transverse hole 22 in the form of an ellipse or similar. The hole 22 thus defines two arms 24 and 26 which extend between the free end 28 of the portion 14 and its end 30 where it connects to the portion 12 forming the contact terminal. The arms 24 and 26 are relatively thin and suitable for being mechanically deformed when the portion 14 is inserted in the plated hole 16. This provides not only electrical connection but also mechanical connection between the electrical contact 12 and the printed circuit 18. Such a solution serves in particular to avoid any need to solder the contact to the printed circuit.

Known techniques for making such electrical contacts of the insertion force type are relatively expensive. They consist in obtaining the general shape of the portion 14 from an initial rolled metal strip of bronze or the like, with the strip then being passed into a special tool that makes, in particular, both the orifice 22 and the outside shape of the portion 14. Such tools are relatively expensive compared with the part that is to be made, and in addition it is necessary to have a particular tool for each size and position of the fixing portion 14 on the contact 12, and thus for each diameter of plated hole 16.

OBJECTS AND SUMMARY OF THE INVENTION

One of the objects of the present invention is to provide a method of manufacturing the fixing portion of an electrical contact of the insertion force type suitable for being implemented solely by means of conventional automatic lathing operations, i.e. operations that do not require any special tool and which can be implemented relatively cheaply.

To achieve this object, the invention provides a method of fabricating the fixing portion of an electrical contact that comprises a fixing portion and a portion forming a contact terminal, said fixing portion having a free end, an end for connection to the terminal-forming portion, and a longitudinal axis extending between said ends, said method comprising the following steps:

a) the side face of said fixing portion is machined in such a manner as to define a surface of revolution about said longitudinal axis;

b) a blind axial bore is drilled in said fixing portion from said free end to extend along said axis over at least a fraction of the length of said fixing portion; and c) said fixing portion is machined in such a manner that in right section in its middle along said longitudinal axis it has, in a first direction orthogonal to a second direction, a dimension of increased size and, through its side wall, two orifices opening out into said axial bore and disposed symmetrically about said longitudinal axis, the orifices sharing a common axis intersecting said longitudinal axis and extending along said second direction.

It will be understood that the various machining operations performed on the fixing portion of the electrical contact can be performed by conventional accessories or tools associated with automatic lathes, such as an axial boring machine, a milling cutter or milling machine, and the lathe proper. These operations can be performed in particular on a numerically controlled automatic lathe having a hollow headstock spindle along which wire or rod feedstock is fed, which lathes are commonly known as "screw machines", even though the present invention does not require screw threads to be cut. Fabrication cost is thus very small, and above all tooling costs for obtaining these shapes is very small, while nevertheless enabling the same mechanical characteristics to be obtained as in contacts of the insertion force type obtained using prior art methods.

In a first implementation, said surface of revolution machined in step a) has a generator line in the form of a curve that is concave towards said longitudinal axis and whose greatest distance from said longitudinal axis is situated substantially halfway along said fixing portion, and step c) consists in machining said side surface of said fixing portion to define two identical substantially cylindrical surface portions having axes that are mutually parallel and orthogonal to said longitudinal axis, said cylindrical surface portions intersecting said axial bore, so that said axial bore opens out into said side surface via two openings that are disposed symmetrically about said longitudinal axis.

In a second implementation, step a) consists in machining the side face of said fixing portion so that it; defines a circularly cylindrical surface about said longitudinal axis, step c) is implemented after steps a) and b), and said step c) comprises the following partial steps:

c1) drilling a hole through the middle zone of said fixing portion, passing right through it on an axis orthogonal to said longitudinal axis and parallel to said second direction; and c2) crushing the middle zone of said fixing portion in said second direction by means of two substantially identical cylindrical surface portions having axes extending parallel to said first direction.

The invention also provides an electrical contact of a type obtained by implementing a different method and comprising a fixing portion suitable for being inserted in an orifice, and a portion forming a contact terminal, said fixing portion having a free end, an end for connection to the terminal-forming portion, a longitudinal axis extending between said ends, and a side surface, wherein said fixing portion comprises a blind axial bore opening out into said free end and extending along at least a fraction of said longitudinal axis, and wherein said side surface is defined by a surface of revolution about said longitudinal axis and by two substantially identical cylindrical surface portions having mutually parallel axes disposed symmetrically about said longitudinal axis and orthogonal thereto, each cylindrical surface portion having an orifice disposed symmetrically and opening out into said axial bore, said orifices being symmetrical about said axial bore and having a common axis orthogonal to said longitudinal axis and to the axes of said cylindrical surface portions.

It will be understood that although the electrical contact of the insertion force type obtained in this way has the same electrical and mechanical properties as those described above, the cost of the means for fabricating said contacts are much smaller than those of conventional techniques, and the same tools can be used to make fixing portions of different dimensions.

BRIEF DESCRIPTION OF THE DRAWINGS

Other characteristics and advantages of the invention appear more clearly on reading the following description of implementations of the invention given by way of non-limiting example, and it being understood that the order in which the operations are performed can be reversed.

The description refers to the accompanying figures, in which.

MORE DETAILED DESCRIPTION

Figure 1:
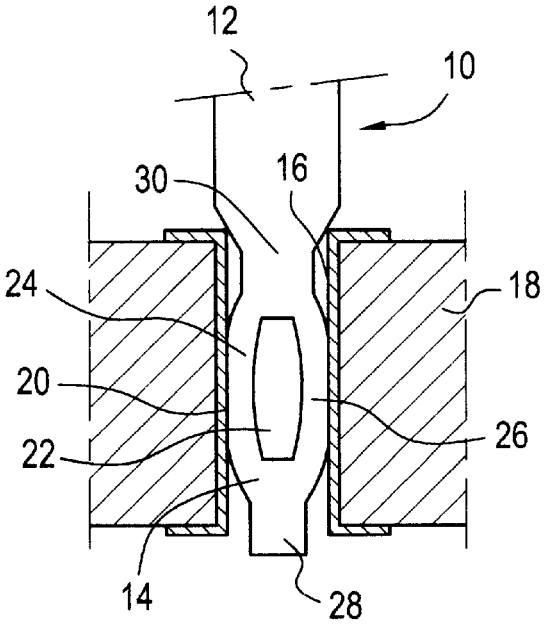
FIG.1 PRIOR ART
FIG. 1 is a vertical section through a conventional type of insertion force contact mounted in a printed circuit board.

With reference initially to FIGS. 2 to 5, there follows a description of a first implementation of the method of fabricating the fixing portion of the electrical contact of the insertion force type. In a first step shown in FIG. 2, the insertion portion 34 is given an external side surface of appropriate shape. More precisely, this surface is obtained by conventional automatic lathe techniques and is constituted, for example, by going from the free end 36 of the portion 34 to its end 38 connected to the portion 32 that forms the connection terminal via a conical end 40, a substantially cylindrical side wall portion 42, and a barrel-shaped portion 44. The side wall portion 44 has a surface of revolution $S_1$ about the longitudinal axis XX'of the portion 34. In the example under consideration, the generator line of the cylindrical surface $S_1$ is a portion of a circle of radius $R_1$. In other words, the point A of the generator line for said surface which is furthest from the axis of revolution XX' lies substantially halfway along the fixing portion.

More generally, the generator line is a curve that is concave when seen from the axis XX' so that the fixing portion presents increased width substantially in its middle.

In a second step, a blind axial bore 46 is formed that opens out in the end 36 of the fixing portion 34. The axial bore has a diameter $D_2$ and a depth 1 making it possible for the orifices 50 and 52 to appear after the third step.

Figure 4:
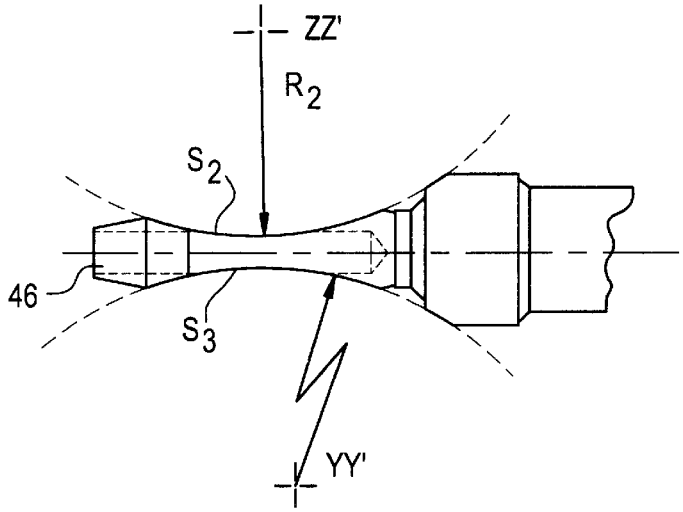
FIG. 4 shows the third step in the machining of the electrical contact.
Figure 5:
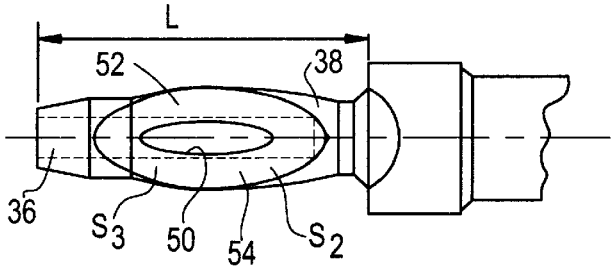
FIG. 5 is a plan view of the fixing portion of the electrical contact obtained by the first implementation of the method of the invention.

In a third step which is shown in FIGS. 4 and 5, the surface of revolution $S_1$ defining the side wall of the fixing portion 34 is modified in part by milling two cylindrical surface portions $S_2$ and $S_3$. These surfaces both have the same radius $R_2$. The axes YY' and ZZ' of these two cylindrical surfaces are spaced apart by an amount such that the surfaces $S_2$ and $S_3$ intersect the axial bore 46. As shown in FIG. 5, this results in two symmetrical orifices 50 and 52 putting the axial bore 46 into communication with the outside and opening out in respective ones of the cylindrical surface portions $S_2$ and $S_3$.

A structure is thus obtained that defines two arms 52 and 54 of small section separated by the axial bore 46 and by the orifices 50 and 52, and connected together at a first end corresponding to the connection end 38 and at their second end corresponding to the free end 36. Thus, in its middle, the fixing portion constituted by the two arms has small thickness in a first direction perpendicular to the longitudinal axis (thickness measured between the two cylindrical surface portions) and larger thickness in a second direction perpendicular to the first, which thickness is greater than that of the free end of the fixing portion.

Naturally the three machining steps could be implemented in an order other than that described above.

It will be understood that this reconstructs the functional structure of the fixing portion 14 of prior art electrical contacts of the insertion force type, as shown in particular in FIG. 1.

Figure 6:
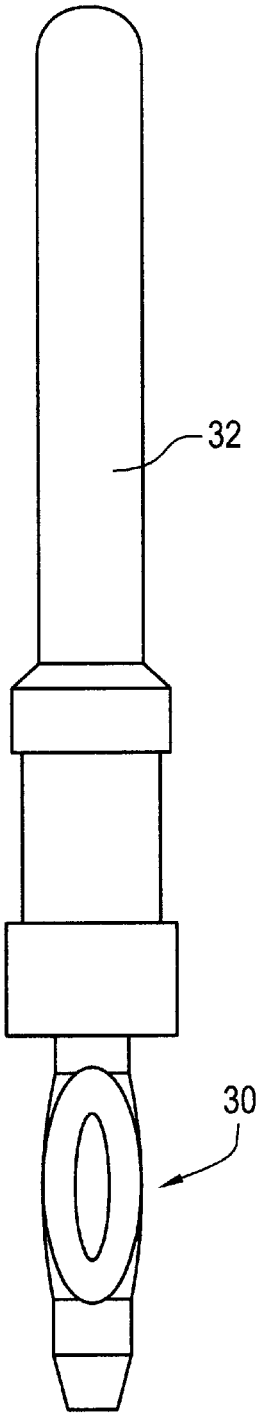
FIG. 6 is an overall elevation view of an electrical contact of the insertion force type obtained by the first implementation of the invention.
Figure 2:
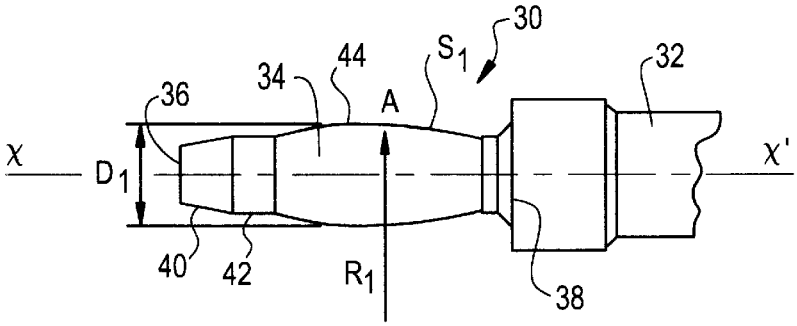
FIG. 2 shows the first machining step in a first method of fabricating the fixing portion of the electrical contact.

FIG. 6 shows a complete electrical contact as obtained by implementing the above-described method. More precisely, this figure shows the fixing portion 30 which is identical to that shown in FIG. 5 together with the portion 32 forming an electrical contact. In the particular example described, the portion 32 constitutes a male terminal. Naturally, the same technique could be used for making a female type contact.

Figure 7:
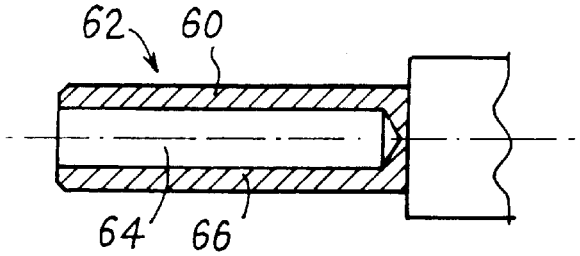
FIG. 7 is a vertical section view showing the first step of the second implementation of the fabrication method.

With reference to FIGS. 7 to 9, there follows a description of a second implementation of the method of fabricating the fixing portion.

Figure 3:
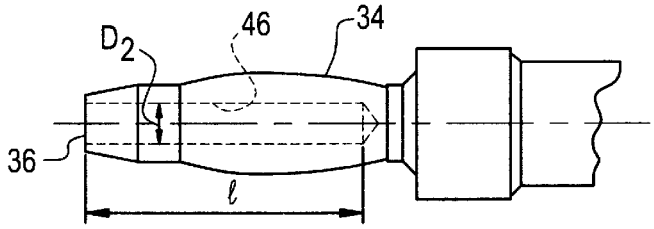
FIG. 3 shows the second step in fabricating the electrical contact.

In a first step shown in FIG. 7, the outside face 60 of the portion 62 of the part that is to constitute the fixing portion is machined by cutting off to give it the form of a cylindrical surface of revolution about the axis XX', and a blind axial bore 64 identical to that shown in FIG. 3 is formed therein. This provides a tube 66 having a wall of relatively thin but constant thickness.

Figure 8A:
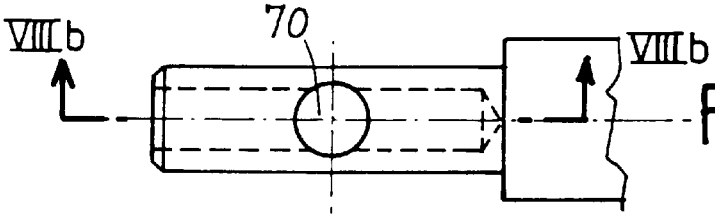
FIGS. 8*a* and 8*b* are respectively a front view and a vertical section on line VIIIb—VIIIb showing the second step of the second implementation of the fabrication method.
Figure 8B:
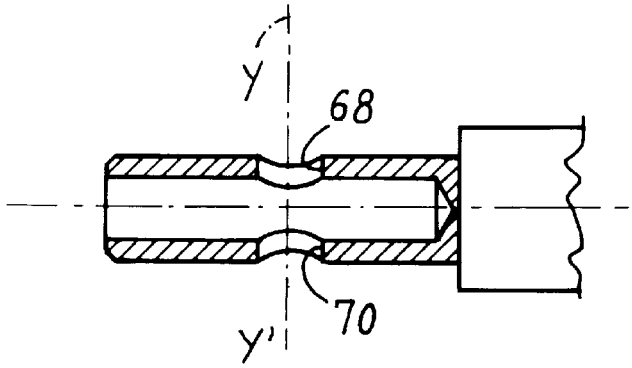

In the following step shown in FIGS. 8*a* and 8*b*, drilling is performed right through the tube 66 on an axis YY' orthogonal to the axis XX' and located in the middle of the portion 62. Thus, by co-operation with the axial bore 64, two holes 68 and 70 are obtained that are disposed symmetrically about the axis XX'.

Figure 9A:
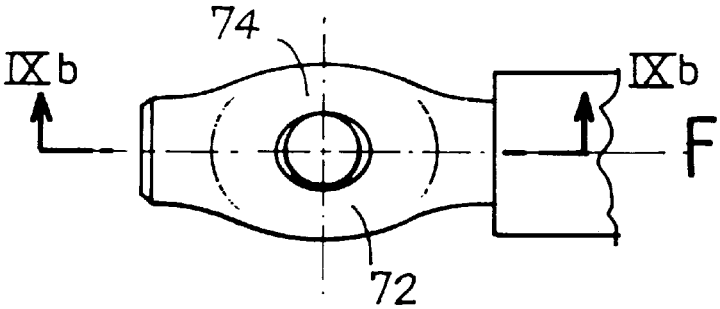
FIGS. 9*a* and 9*b* are respectively a front view and a vertical section view on line IXb–IXb in FIG. 9*a* showing the third step of the second implementation of the fabrication method of the invention.
Figure 9B:
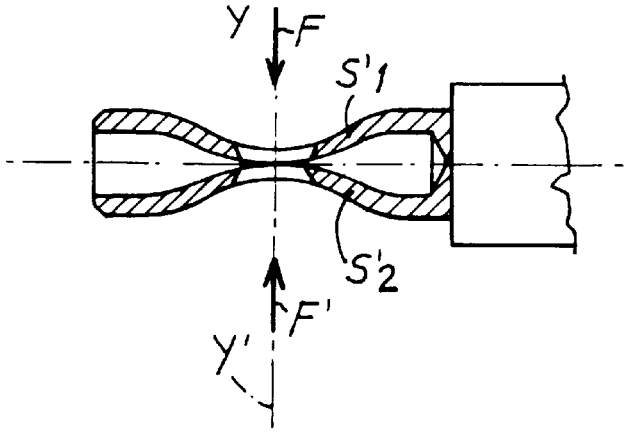

In the last step shown in FIGS. 9*a* and 9*b*, the middle of the tube 66 including the holes 68 and 70 is crushed between two tools shaped as portions of cylindrical surfaces and applied in directions F and F' i.e. directions that coincide substantially with the axis YY' of the holes 68 and 70. This provides both two cylindrical surface portions $S'_1$ and $S'_2$ whose axes are perpendicular to the longitudinal axis XX', and also an "enlargement" of the tube in zones 72 and 74. This provides two arms that have good deformability when the electrical contact is inserted into a plated hole of a printed circuit.

It will be understood that both implementations of the invention enable electrical contacts of the insertion force type to be obtained by simple automatic lathe operations while having the same qualities as prior art electrical contacts of the same type.

In addition, it is possible to modulate the geometrical characteristics of the connection portion while using the same automatic lathing tools. More precisely, it is possible to vary:

shapes to act on the insertion and extraction forces relative to a given plated hole;

dimensions to enable connection to be made regardless of the diameter of the receiving hole; and the positioning of this type of connection for a given contact, thereby enabling the printed circuit card to be lowered or raised relative to the connector.

We claim:

1. A method of fabricating a fixing portion of an electrical contact which comprises said fixing portion and a portion forming a contact terminal, said fixing portion having a free end, an end for connection to the terminal-forming portion, a longitudinal axis extending between said ends and a side face, said method comprising the steps of;

a) machining the side face of said fixing portion in such a manner as to define a surface of revolution about said longitudinal axis, said surface of revolution having a diameter;

b) drilling a blind axial bore in said fixing portion from said free end to extend along said axis over at least a fraction of the length of said fixing portion; and c) machining said fixing portion in such a manner that a first dimension extending between exterior surface of a middle part of the fixing portion is greater than a second dimension extending between exterior surfaces of the middle part of the fixing portion, said first and second dimensions being taken in mutually perpendicular directions that both lie in a plane perpendicular to the longitudinal axis, said second dimension being less than said diameter of said surface of said surface of revolution such that two orifices are formed to open into the axial bore and into the side face, the two orifices intersecting the longitudinal axis and having a common axis extending in said second direction.

2. A method of fabrication according to claim 1, wherein step a) comprises the step of machining said surface of revolution so that it has a generator line in the form of a curve that is concave towards said longitudinal axis and whose greatest distance from said longitudinal axis is situated substantially halfway along said fixing portion.

3. A method according to claim 2, wherein a conical portion is further machined surrounding the open end of said axial bore.

4. A fabrication method according to claim 2, wherein the step of machining the surface of revolution so that it has a generator line comprises the step of machining the surface of revolution so that said generator line is an arc of a circle.

5. A method of fabricating a fixing portion of an electrical contact which comprises said fixing portion and a portion forming a contact terminal, said fixing portion having a free end, an end for connection to the terminal-forming portion, a longitudinal axis extending between said ends and a side face, said method comprising the steps of;

a) machining the side face of said fixing portion in such a manner as to define a surface of revolution about said longitudinal axis;

b) drilling a blind axial bore in said fixing portion from said free end to extend along said axis over at least a fraction of the length of said fixing portion; and c) machining said fixing portion in such a manner that a middle part of the fixing portion, in a plane perpendicular to the longitudinal axis, has a greater dimension in a first direction than in a second direction perpendicular to the first direction, and such that two orifices are formed to open into the axial bore and into the side face, the two orifices intersecting the longitudinal axis and having a common axis extending in said second direction;

wherein step a) comprises the step of machining said surface of revolution so that it has a generator line in the form of a curve that is concave towards said longitudinal axis and whose greatest distance from said longitudinal axis is situated substantially halfway along said fixing portion; and wherein step c) comprises the step of machining the side surface of the fixing portion to define two identical substantially cylindrical surface portions having axes that are mutually parallel and that are perpendicular to the longitudinal axis, said cylindrical surface portions intersecting said axial bore, so that said axial bore opens out into said side surface via two openings that are disposed symmetrically about said longitudinal axis.

6. A method of fabricating a fixing portion of an electrical contact which comprises said fixing portion and a portion forming a contact terminal, said fixing portion having a free end, an end for connection to the terminal-forming portion, a longitudinal axis extending between said ends and a side face, said method comprising the steps of;

a) machining the side face of said fixing portion in such a manner as to define a circularly cylindrical surface about said longitudinal axis;

b) drilling a blind axial bore in said fixing portion from said free end to extend along said axis over at least a fraction of the length of said fixing portion; and c) after performing steps a) and b), machining said fixing portion in such a manner that a middle part of the fixing portion, in a plane perpendicular to the longitudinal axis, has a greater dimension in a first direction than in a second direction perpendicular to the first direction, and such that two orifices are formed to open into the axial bore and into the side face, the two orifices intersecting the longitudinal axis and having a common axis extending in said second direction;

wherein step c) comprising the steps of:

c1) drilling a hole through the middle part of said fixing portion, said hole passing through the middle part along an axis perpendicular to said longitudinal axis and parallel to said second direction; and c2) crushing the middle part of said fixing portion in said second direction by means of two substantially identical cylindrical surface portions having axes extending parallel to said first direction.

* * * * *

UNITED STATES PATENT AND TRADEMARK OFFICE

CERTIFICATE OF CORRECTION

PATENT NO. : 5,915,759

DATED : June 29, 1999

INVENTOR(S) : Bernard LOGEROT et al.

It is certified that error appears in the above-identified patent and that said Letters Patent is hereby corrected as shown below:

Column 3, line 61, change "1" to —I—;

Column 5, line 35, delete "of said surface" (second occurrence); and

Column 6, line 48, change ";" to —,—.

Signed and Sealed this

Tenth Day of October, 2000

*Attest:*

*Attesting Officer*

Q. TODD DICKINSON

*Director of Patents and Trademarks*